US005863402A

United States Patent [19]

Castegnier et al.

[11] Patent Number: 5,863,402

[45] Date of Patent: Jan. 26, 1999

[54] METHOD OF PREVENTING ANODE ABRASION DURING ELECTROCOAGULATION PRINTING

[75] Inventors: Adrien Castegnier, Outremont; Normand Lepine, Pointe-aux-Tremble, both of Canada

[73] Assignee: Elcorsy Technology Inc., Saint-Laurent, Canada

[21] Appl. No.: 925,778

[22] Filed: Sep. 9, 1997

[51] Int. Cl.[6] ..... C25D 13/04

[52] U.S. Cl. ..... 204/486; 204/483; 204/508; 101/DIG. 9

[58] Field of Search ..... 204/486, 483, 204/508; 101/DIG. 9

[56] References Cited

U.S. PATENT DOCUMENTS

| | | | |
|---|---|---|---|
| 4,661,222 | 4/1987 | Castegnier | 204/180.9 |
| 4,895,629 | 1/1990 | Castegnier | 204/180.9 |
| 5,449,392 | 9/1995 | Castegnier et al. | 218/46 |
| 5,538,601 | 7/1996 | Castegnier | 204/486 |
| 5,690,801 | 11/1997 | Castegnier | 204/486 |
| 5,690,802 | 11/1997 | Castegnier | 204/486 |
| 5,690,803 | 11/1997 | Castegnier | 204/486 |

*Primary Examiner*—Kathryn L. Gorgos
*Assistant Examiner*—Kishor Mayekar
*Attorney, Agent, or Firm*—Swabey Ogilvy Renault

[57] ABSTRACT

An electrocoagulation printing method comprises the steps of (a) providing a positive electrolytically inert electrode having a continuous passivated surface moving at substantially constant speed along a predetermined path, the passivated surface defining a positive electrode active surface; (b) coating the positive electrode active surface with an olefinic substance and silica to form on the surface micro-droplets of olefinic substance containing the silica; (c) forming on the olefin and silica-coated positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and (d) bringing a substrate into contact with the olefin and silica-coated positive electrode active surface to cause transfer of the dots of colored, coagulated colloid from the surface onto the substrate and thereby imprint the substrate with the image. The use in step (b) of silica prevents abrasion and pitting of the positive electrode, without substantially affecting passivation. The use of silica also prevents the formation of undesirable background on the printed image in step (d).

69 Claims, No Drawings

METHOD OF PREVENTING ANODE ABRASION DURING ELECTROCOAGULATION PRINTING

BACKGROUND OF THE INVENTION

The present invention pertains to improvements in the field of electrocoagulation printing. More particularly, the invention relates to a method of preventing anode abrasion during electrocoagulation printing.

In U.S. Pat. No. 4,895,629 of Jan. 23, 1990, applicant has described a high-speed electrocoagulation printing method and apparatus in which use is made of a positive electrode in the form of a revolving cylinder having a passivated surface onto which dots of colored, coagulated colloid representative of an image are produced. These dots of colored, coagulated colloid are thereafter contacted with a substrate such as paper to cause transfer of the colored, coagulated colloid onto the substrate and thereby imprint the substrate with the image. As explained in this patent, the positive electrode is coated with a dispersion containing an olefinic substance and a metal oxide prior to electrical energization of the negative electrodes in order to weaken the adherence of the dots of coagulated colloid to the positive electrode and also to prevent an uncontrolled corrosion of the positive electrode. In addition, gas generated as a result of electrolysis upon energizing the negative electrodes is consumed by reaction with the olefinic substance so that there is no gas accumulation between the negative and positive electrodes.

The electrocoagulation printing ink which is injected into the gap defined between the positive and negative electrodes consists essentially of a liquid colloidal dispersion containing an electrolytically coagulable colloid, a dispersing medium, a soluble electrolyte and a coloring agent. Where the coloring agent used is a pigment, a dispersing agent is added for uniformly dispersing the pigment into the ink. After coagulation of the colloid, any remaining non-coagulated colloid is removed from the surface of the positive electrode, for example, by scraping the surface with a soft rubber squeegee, so as to fully uncover the colored, coagulated colloid which is thereafter transferred onto the substrate. The surface of the positive electrode is thereafter cleaned by means of a plurality of rotating brushes and a cleaning liquid to remove any residual coagulated colloid adhered to the surface of the positive electrode.

When a polychromic image is desired, the negative and positive electrodes, the positive electrode coating device, ink injector, rubber squeegee and positive electrode cleaning device are arranged to define a printing unit and several printing units each using a coloring agent of different color are disposed in tandem relation to produce several differently colored images of coagulated colloid which are transferred at respective transfer stations onto the substrate in superimposed relation to provide the desired polychromic image. Alternatively, the printing units can be arranged around a single roller adapted to bring the substrate into contact with the dots of colored, coagulated colloid produced by each printing unit, and the substrate which is in the form of a continuous web is partially wrapped around the roller and passed through the respective transfer stations for being imprinted with the differently colored images in superimposed relation.

Applicant has observed that the metal oxide used in combination with the olefin substance for coating the positive electrode causes abrasion and pitting of the positive electrode so that it is necessary to regrind the surface of such an electrode after every forty hours of printing. This of course requires shutdown of the printing apparatus and removal of the electrode. Where a positive electrode made of stainless steel or aluminum is utilized, $Fe^{3+}$ or $Al^{3+}$ ions are released from the surface of the electrode as a result of the abrasion and pitting thereof. As explained in Applicant's copending U.S. application Ser. No. 08/376,245, filed on Jan. 23, 1995 these ions crosslink the colloid contained in the ink, resulting in a viscosity increase leading to an ultimate gelation of the ink.

Applicant has also observed that the metal oxide in combination with the olefinic substance retain on the surface of the positive electrode a film of ink which is transferred with the colored, coagulated colloid onto the substrate during contact with same. Thus, when black, cyan, magenta and yellow coloring agents are used to provide a polychromic image, the residual films containing these coloring agents upon being transferred onto the substrate in superimposed relation create on the printed image an undesirable colored background.

SUMMARY OF THE INVENTION

It is therefore an object of the present invention to overcome the above drawbacks and to provide a method of preventing anode abrasion during electrocoagulation printing.

It is another object of the invention to prevent the formation of undesirable background on electrocoagulation printed images.

In accordance with the present invention, there is thus provided an electrocoagulation printing method comprising the steps of:

a) providing a positive electrolytically inert electrode having a continuous passivated surface moving at substantially constant speed along a predetermined path, the passivated surface defining a positive electrode active surface;

b) coating the positive electrode active surface with an olefinic substance and silica to form on the surface microdroplets of olefinic substance containing the silica;

c) forming on the olefin and silica-coated positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent; and d) bringing a substrate into contact with the olefin and silica-coated positive electrode active surface to cause transfer of the dots of colored, coagulated colloid from the surface onto the substrate and thereby imprint said substrate with the image.

It has surprisingly been found, according to the invention, that by replacing the aforesaid metal oxide with silica, one eliminates the abrasion and pitting of the positive electrode, without substantially affecting passivation, so that the requirement to regrind the surface of the positive electrode is significantly reduced by at least 80%. Moreover, since there is no longer any release of contaminant ions from the surface of the positive electrode due to abrasion and pitting thereof, the ink is stable and does not undergo an undesirable increase in viscosity during electrocoagulation printing. Thus, there is no longer any need to utilize two separate inks, that is, a starting ink and a replenishing ink having different concentrations of sequestering agent, as proposed in the aforementioned U.S. application Ser. No. 08/376,245, and one may use only the starting ink which contains a sequestering agent for complexing other contaminant ions.

In addition, the use of silica in step (b) of the aforementioned electrocoagulation printing method enables any remaining ink to be removed from the surface of the positive electrode by the aforesaid rubber squeegee, without altering the dots of colored, coagulated colloid. Thus, there is no longer any need to apply on the surface of the positive electrode between steps (c) and (d) a liquid olefinic substance with a view to preventing formation of undesirable background on the printed image in step (d), as proposed in Applicant's U.S. Pat. No. 5,681,436 of Jan. 29, 1996.

Where a polychromic image is desired, steps (b), (c) and (d) of the above electrocoagulation printing method are repeated several times to define a corresponding number of printing stages arranged at predetermined locations along the aforesaid path and each using a coloring agent of different color, and to thereby produce several differently colored images of coagulated colloid which are transferred at the respective transfer positions onto the substrate in superimposed relation to provide a polychromic image. It is also possible to repeat several times steps (a) through (d) to define a corresponding number of printing stages arranged in tandem relation and each using a coloring agent of different color, and to thereby produce several differently colored images of coagulated colloid which are transferred at respective transfer positions onto the substrate in superimposed relation to provide a polychromic image, the substrate being in the form of a continuous web which is passed through the respective transfer positions for being imprinted with the colored images at the printing stages. Alternatively, the printing stages defined by repeating several times steps (a) through (d) can be arranged around a single roller adapted to bring the substrate into contact with the dots of colored, coagulated colloid of each printing stage and the substrate which is in the form of a continuous web is partially wrapped around the roller and passed through the respective transfer positions for being imprinted with the colored images at the printing stages. The last two arrangements are described in Applicant's U.S. Pat. No. 4,895,629.

When a polychromic image of high definition is desired, it is preferable to bring an endless non-extendible belt moving at substantially the same speed as the positive electrode active surface and having on one side thereof a colloid retaining surface adapted to releasably retain dots of electrocoagulated colloid to cause transfer of the differently colored images at the respective transfer positions onto the colloid retaining surface of such a belt in superimposed relation to provide a polychromic image, and thereafter bring the substrate into contact with the colloid retaining surface of the belt to cause transfer of the polychromic image from the colloid retaining surface onto the substrate and to thereby imprint the substrate with the polychromic image. As explained in a copending US patent application in the name of the Applicant, filed concurrently with the present application, by utilizing an endless non-extendible belt having a colloid retaining surface such as a porous surface on which dots of colored, coagulated colloid can be transferred and by moving such a belt independently of the positive electrode, from one printing unit to another, so that the colloid retaining surface of the belt contacts the colored, coagulated colloid in sequence, it is possible to significantly improve the registration of the differently colored images upon their transfer onto the colloid retaining surface of the belt, thereby providing a polychromic image of high definition which can thereafter be transferred onto the paper web or other substrate. For example, use can be made of a belt comprising a plastic material having a porous coating of silica.

Accordingly, the present invention also provides, in another aspect thereof, a multicolor electrocoagulation printing method comprising the steps of:

a) providing a positive electrolytically inert electrode having a continuous passivated surface moving at substantially constant speed along a predetermined path, the passivated surface defining a positive electrode active surface;

b) coating the positive electrode active surface with an olefinic substance and silica to form on the surface microdroplets of olefinic substance containing the silica;

c) forming on the olefin and silica-coated positive electrode active surface a plurality of dots of colored, coagulated colloid representative of a desired image, by electrocoagulation of an electrolytically coagulable colloid present in an electrocoagulation printing ink comprising a liquid colloidal dispersion containing the electrolytically coagulable colloid, a dispersing medium, a soluble electrolyte and a coloring agent;

d) bringing an endless non-extendible belt moving at substantially the same speed as the positive electrode and having on one side thereof a colloid retaining surface adapted to releasably retain dots of electrocoagulated colloid, into contact with the olefin and silica-coated positive electrode active surface to cause transfer of the dots of colored, coagulated colloid from the positive electrode active surface onto the colloid retaining surface of the belt and to thereby imprint the colloid retaining surface with the image;

e) repeating steps (b), (c) and (d) several times to define a corresponding number of printing stages arranged at predetermined locations along the path and each using a coloring agent of different color, and to thereby produce several differently colored images of coagulated colloid which are transferred at respective transfer positions onto the porous surface in superimposed relation to provide a polychromic image; and f) bringing a substrate into contact with the porous surface of the belt to cause transfer of the polychromic image from the porous surface onto the substrate and to thereby imprint the substrate with the polychromic image.

DESCRIPTION OF PREFERRED EMBODIMENTS

The positive electrode used can be in the form of a moving endless belt as described in Applicant's U.S. Pat. No. 4,661,222, or in the form of a revolving cylinder as described in the aforementioned U.S. Pat. Nos. 4,895,629 and 5,538,601, the teachings of which are incorporated herein by reference. In the later case, the printing stages are arranged around the positive cylindrical electrode. Preferably, the positive electrode active surface and the ink are maintained at a temperature of about 35°–60° C., preferably 40° C., to increase the viscosity of the coagulated colloid in step (c) so that the dots of colored, coagulated colloid remain coherent during their transfer in step (d), thereby enhancing transfer of the colored, coagulated colloid onto the substrate. For example, the positive electrode active surface can be heated at the desired temperature and the ink applied on the heated electrode surface to cause a transfer of heat therefrom to the ink.

Examples of suitable olefinic substances which may be used to coat the surface of the positive electrode in step (b)

include unsaturated fatty acids such as arachidonic acid, linoleic acid, linolenic acid, oleic acid and palmitoleic acid and unsaturated vegetable oils such as corn oil, linseed oil, olive oil, peanut oil, soybean oil and sunflower oil. Oleic acid is particularly preferred. The olefinic substance is advantageously applied onto the positive electrode active surface in the form of an oily dispersion containing the silica as dispersed phase. Use is preferably made of a precipitated silica having a surface area of about 100 to 500 $m^2/g$ as measured by the BET (Brunaver-Emmet-Teller) nitrogen adsorption method. The surface of precipitated silica contains silanol group (SiOH). A particularly preferred silica is one having a BET surface area of about 400 $m^2/g$, which is sold by Degussa Corporation under product No. FK500LS. The amount of silica may range from about 5 about 30% by weight, based on the total weight of the dispersion. A particularly preferred dispersion contains about 92.5 wt. % of olefinic substance and about 7.5 wt. % of silica.

The oily dispersion containing the olefinic substance and the silica is advantageously applied onto the positive electrode active surface by providing a distribution roller extending parallel to the positive cylindrical electrode and having a peripheral coating comprising an oxide ceramic material, applying the oily dispersion onto the ceramic coating to form on a surface thereof a film of the oily dispersion uniformly covering the surface of the ceramic coating, the film of oily dispersion breaking down into micro-droplets containing the olefinic substance in admixture with the silica and having substantially uniform size and distribution, and transferring the micro-droplets from the ceramic coating onto the positive electrode active surface. As explained in Applicant's U.S. Pat. No. 5,449,392 of Sep. 12, 1995, the teaching of which is incorporated herein by reference, the use of a distribution roller having a ceramic coating comprising an oxide ceramic material enables one to form on a surface of such a coating a film of the oily dispersion which uniformly covers the surface of the ceramic coating and thereafter breaks down into micro-droplets containing the olefinic substance in admixture with the silica and having substantially uniform size and distribution. The micro-droplets formed on the surface of the ceramic coating and transferred onto the positive electrode active surface generally have a size ranging from about 1 to about 5 $\mu$m.

A particularly preferred oxide ceramic material forming the aforesaid ceramic coating comprises a fused mixture alumina and titania. Such a mixture may comprise about 60 to about 90 weight % of alumina and about 10 to about 40 weight % of titania.

According to a preferred embodiment of the invention, the oily dispersion is applied onto the ceramic coating by disposing an applicator roller parallel to the distribution roller and in pressure contact engagement therewith to form a first nip, and rotating the applicator roller and the distribution roller in register while feeding the oily dispersion into the first nip, whereby the oily dispersion upon passing through the first nip forms a film uniformly covering the surface of the ceramic coating. The micro-droplets are advantageously transferred from the distribution roller to the positive electrode by disposing a transfer roller parallel to the distribution roller and in contact engagement therewith to form a second nip, positioning the transfer roller in pressure contact engagement with the positive electrode to form a third nip, and rotating the transfer roller and the positive electrode in register for transferring the micro-droplets from the distribution roller to the transfer roller at the second nip and thereafter transferring the micro-droplets from the transfer roller to the positive electrode at the third nip. Such an arrangement of rollers is described in the aforementioned U.S. Pat. No. 5,449,392.

Preferably, the applicator roller and the transfer roller are each provided with a peripheral covering of a resilient material which is resistant to attack by the olefinic substance, such as a synthetic rubber material. For example, use can be made of a polyurethane having a Shore A hardness of about 50 to about 70 in the case of the applicator roller, or a Shore A hardness of about 60 to about 80 in the case of the transfer roller.

When use is made of a positive electrode of cylindrical configuration rotating at substantially constant speed about its central longitudinal axis, step (c) of the above electrocoagulation printing method is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of the positive electrode and spaced from the positive electrode active surface by a constant predetermined gap, the negative electrodes being spaced from one another by a distance at least equal to the electrode gap;

ii) filling the electrode gap with the aforesaid electrocoagulation printing ink;

iii) electrically energizing selected ones of the negative electrodes to cause point-by-point selective coagulation and adherence of the colloid onto the olefin and silica-coated positive electrode active surface opposite the electrode active surfaces of the energized negative electrodes while the positive electrode is rotating, thereby forming the dots of colored, coagulated colloid; and iv) removing any remaining non-coagulated colloid from the positive electrode active surface.

As explained in U.S. Pat. No. 4,895,629, spacing of the negative electrodes from one another by a distance which is equal to or greater than the electrode gap prevents the negative electrodes from undergoing edge corrosion. On the other hand, coating of the positive electrode with an olefinic substance and a silica prior to electrical energization of the negative electrodes weakens the adherence of the dots of coagulated colloid to the positive electrode and also prevents an uncontrolled corrosion of the positive electrode. In addition, gas generated as a result of electrolysis upon energizing the negative electrodes is consumed by reaction with the olefinic substance so that there is no gas accumulation between the negative and positive electrodes.

Examples of suitable electrolytically inert metals from which the positive and negative electrodes can be made are stainless steel, platinum, chromium, nickel and aluminum. The positive electrode is preferably made of stainless steel, aluminum or tin so that upon electrical energization of the negative electrodes, dissolution of the passive oxide film on such an electrode generates trivalent ions which then initiate coagulation of the colloid.

The gap which is defined between the positive and negative electrodes can range from about 50 $\mu$m to about 100 $\mu$m, the smaller the electrode gap-the sharper are the dots of coagulated colloid produced. Where the electrode gap is of the order of 50 $\mu$m, the negative electrodes are preferably spaced from one another by a distance of about 75 $\mu$m.

The olefin and silica-coated positive active surface is preferably polished to increase the adherence of the micro-droplets onto the positive electrode active surface, prior to step (c) (ii). For example, use can be made of a rotating brush provided with a plurality of radially extending bristles made of horsehair and having extremities contacting the surface of the positive electrode. The friction caused by the bristles contacting the surface upon rotation of the brush has been found to increase the adherence of the micro-droplets onto the positive electrode active surface.

Where the positive cylindrical electrode extends vertically, step (c) (ii) of the above electrocoagulation printing method is advantageously carried out by continuously discharging the ink onto the positive electrode active surface from a fluid discharge means disposed adjacent the electrode gap at a predetermined height relative to the positive electrode and allowing the ink to flow downwardly along the positive electrode active surface, the ink being thus carried by the positive electrode upon rotation thereof to the electrode gap to fill same. Preferably, excess ink flowing downwardly off the positive electrode active surface is collected and the collected ink is recirculated back to the fluid discharge means.

The colloid generally used is a linear colloid of high molecular weight, that is, one having a weight average molecular weight between about 10,000 and about 1,000,000, preferably between 100,000 and 600,000. Examples of suitable colloids include natural polymers such as albumin, gelatin, casein and agar, and synthetic polymers such as polyacrylic acid, polyacrylamide and polyvinyl alcohol. A particularly preferred colloid is an anionic copolymer of acrylamide and acrylic acid having a weight average molecular weight of about 250,000 and sold by Cyanamid Inc. under the trade mark ACCOSTRENGTH 86. The colloid is preferably used in an amount of about 6.5 to about 12% by weight, and more preferably in an amount of about 7% by weight, based on the total weight of the colloidal dispersion. Water is preferably used as the medium for dispersing the colloid to provide the desired colloidal dispersion.

The ink also contains a soluble electrolyte and a coloring agent. Preferred electrolytes include alkali metal halides and alkaline earth metal halides, such as lithium chloride, sodium chloride, potassium chloride and calcium chloride. Potassium chloride is particularly preferred. When operating at a temperature of about 35°–60° C., the electrolyte is preferably used in an amount of about 4.5 to about 10% by weight, based on the total weight of the dispersion. The coloring agent can be a dye or a pigment. Examples of suitable dyes which may be used to color the colloid are the water soluble dyes available from HOECHST such a Duasyn Acid Black for coloring in black and Duasyn Acid Blue for coloring in cyan, or those available from RIEDEL-DEHAEN such as Anti-Halo Dye Blue T. Pina for coloring in cyan, Anti-Halo Dye AC Magenta Extra V01 Pina for coloring in magenta and Anti-Halo Dye Oxonol Yellow N. Pina for coloring in yellow. When using a pigment as a coloring agent, use can be made of the pigments which are available from CABOT CORP. such as Carbon Black Monarch® 120 for coloring in black, or those available from HOECHST such as Hostaperm Blue B2G or. B3G for coloring in cyan, Permanent Rubine F6B or L6B for coloring in magenta and Permanent Yellow DGR or DHG for coloring in yellow. A dispersing agent is added for uniformly dispersing the pigment into the ink. Examples of suitable dispersing agents include the anionic dispersing agent sold by Boehme Filatex Canada Inc. under the trade mark CLOSPERSE 25000. The pigment is preferably used in an amount of about 6.5 to about 15% by weight, and the dispersing agent in an amount of about 0.1 to about 0.1% by weight, based on the total weight of the ink.

After coagulation of the colloid, any remaining non-coagulated colloid is removed from the positive electrode active surface, for example, by scraping the surface with a soft rubber squeegee, so as to fully uncover the colored, coagulated colloid. Preferably, the non-coagulated colloid thus removed is collected and mixed with the collected ink, and the collected non-coagulated colloid in admixture with the collected ink is recirculated back to the aforesaid fluid discharge means.

The optical density of the dots of colored, coagulated colloid may be varied by varying the voltage and/or pulse duration of the pulse-modulated signals applied to the negative electrodes.

According to a preferred embodiment, step (d) is preferably carried out by providing at each transfer position a pressure roller extending parallel to the positive cylindrical electrode and pressed thereagainst to form a nip and permit the pressure roller to be driven by the positive electrode upon rotation thereof, and passing the substrate or belt through the nip. Preferably, the pressure roller is provided with a peripheral covering of a synthetic rubber material such as a polyurethane having a Shore A hardness of about 95. A polyurethane covering with such a hardness has been found to further improve transfer of the colored, coagulated colloid from the positive electrode active surface onto the porous surface of the belt. The pressure exerted between the positive electrode and the pressure roller preferably ranges from about 50 to about 100 kg/cm$^2$. In a particularly preferred embodiment, there are at least two printing stages each including one such pressure roller and wherein the pressure rollers are arranged in pairs with the pressure rollers of each pair being diametrically opposed to one another. The provision of two pairs of diametrically opposed pressure rollers arranged about the positive cylindrical electrode prevents such an electrode from flexing since the forces exerted by the pressure rollers of each pair cancel each other out.

After step (d), the positive electrode active surface is generally cleaned to remove therefrom any remaining coagulated colloid. According to a preferred embodiment, the positive electrode is rotatable in a predetermined direction and any remaining coagulated colloid is removed from the positive electrode active surface by providing an elongated rotatable brush extending parallel to the longitudinal axis of the positive electrode, the brush being provided with a plurality of radially extending bristles made of horsehair and having extremities contacting the positive electrode active surface, rotating the brush in a direction opposite to the direction of rotation of the positive electrode so as to cause the bristles to frictionally engage the positive electrode active surface, and directing jets of cleaning liquid; under pressure against the positive electrode active surface, from either side of the brush. In such an embodiment, the positive electrode active surface and the ink are preferably maintained at a temperature of about 35°–60° C by heating the cleaning liquid to thereby heat the positive electrode active surface upon contacting same and applying the ink on the heated electrode surface to cause a transfer of heat therefrom to the ink.

Preferably, the electrocoagulation printing ink contains water as the dispersing medium and the dots of differently colored, coagulated colloid representative of the polychromic image are moistened between the aforementioned steps (e) and (f) so that the polychromic image is substantially completely transferred onto the substrate in step (f).

According to another preferred embodiment, the substrate is in the form of a continuous web and step (f) is carried out by providing a support roller and a pressure roller extending parallel to the support roller and pressed thereagainst to form a nip through which the belt is passed, the support roller and pressure roller being driven by the belt upon movement thereof, and guiding the web so as to pass-through the nip between the pressure roller and the porous surface of the belt for imprinting the web with the polychromic image. Preferably, the belt with the porous surface thereof imprinted with the polychromic image is guided so as to travel along a path extending in a plane intersecting the longitudinal axis of the positive electrode at right angles, thereby exposing the porous surface to permit contacting thereof by the web. Where the longitudinal axis of the positive electrode extends vertically, the belt is preferably guided so as to travel along a horizontal path with the porous surface facing downwardly, the support roller and pressure roller having rotation axes disposed in a plane extending perpendicular to the horizontal path. Such an arrangement is described in the aforementioned U.S. application filed concurrently with the present application, the teaching of which is incorporated herein by reference.

After step (f), the porous surface of the belt is generally cleaned to remove therefrom any remaining coagulated colloid. According to a preferred embodiment, any remaining coagulated colloid is removed from the porous surface of the belt by providing at least one elongated rotatable brush disposed on the one side of the belt and at least one support roller extending parallel to the brush and disposed on the opposite side of the belt, the brush and support roller having rotation axes disposed in a plane extending perpendicular to the belt, the brush being provided with a plurality of radially extending bristles made of horsehair and having extremities contacting the porous surface, rotating the brush in a direction opposite to the direction of movement of the belt so as to cause the bristles to frictionally engage the porous surface while supporting the belt with the support roller, directing jets of cleaning liquid under pressure against the porous surface from either side of the brush and removing the cleaning liquid with any dislodged coagulated colloid from the porous surface.

The method of the invention enables one to eliminate the abrasion and pitting of the positive electrode, without substantially affecting passivation, and to prevent the formation of undesirable background on the printed images.

We claim:

1. An electrocoagulation printing method comprising the steps of:

a) providing a positive electrolytically inert electrode having a continuous passivated surface moving at a constant speed along a selected path, said passivated surface defining a positive electrode active surface;

b) coating the positive electrode active surface with an olefinic substance and silica to form on said surface micro-droplets of olefinic substance containing the silica;

c) forming on the olefin and silica-coated positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent; and d) bringing a substrate into contact with the olefin and silica-coated positive electrode active surface to cause transfer of the dots of colored, coagulated colloid from said surface onto said substrate and to imprint said substrate with said image.

2. A method as claimed in claim 1, wherein steps (b), (c) and (d) are repeated several times to define a corresponding number of printing stages arranged at selected locations along said path and each using a coloring agent of different color, and to produce several differently colored images of coagulated colloid which are transferred at respective transfer positions onto said substrate in superimposed relation to provide a polychromic image.

3. A method as claimed in claim 2, wherein said positive electrode is a cylindrical electrode having a central longitudinal axis and rotating at substantially constant speed about said longitudinal axis, and wherein said printing stages are arranged around said positive cylindrical electrode.

4. A method as claimed in claim 3, wherein step (b) is carried out by providing a distribution roller extending parallel to said positive electrode and having a peripheral coating comprising an oxide ceramic material, applying said olefinic substance in the form of an oily dispersion containing said silica as dispersed phase onto the ceramic coating to form on a surface thereof a film of said oily dispersion uniformly covering the surface of said ceramic coating, said film of oily dispersion breaking down into micro-droplets containing said olefinic substance in admixture with said silica and having substantially uniform size and distribution, and transferring said micro-droplets from said ceramic coating onto said positive electrode active surface.

5. A method as claimed in claim 4, wherein said oxide ceramic material comprises a fused mixture of alumina and titania.

6. A method as claimed in claim 4, wherein said oily dispersion is applied onto said ceramic coating by disposing an applicator roller parallel to said distribution roller and in pressure contact engagement therewith to form a first nip, and rotating said applicator roller and said distribution roller in register while feeding said oily dispersion into said first nip, such that said oily dispersion upon passing through said first nip forms said film uniformly covering the surface of said ceramic coating.

7. A method as claimed in claim 6, wherein said micro-droplets are transferred from said distribution roller to said positive electrode by disposing a transfer roller parallel to said distribution roller and in contact engagement therewith to form a second nip, positioning said transfer roller in pressure contact engagement with said positive electrode to form a third nip, and rotating said transfer roller and said positive electrode in register for transferring said micro-droplets from said distribution roller to said transfer roller at said second nip and thereafter transferring said micro-droplets from said transfer roller to said positive electrode at said third nip.

8. A method as claimed in claim 7, wherein said applicator roller and said transfer roller are each provided with a peripheral covering of a resilient material which is resistant to attack by said olefinic substance.

9. A method as claimed in claim 4, wherein said silica is present in said oily dispersion in an amount of about 5 to about 30% by weight, based on the total weight of said dispersion.

10. A method as claimed in claim 9, wherein the amount of silica is about 7.5% by weight.

11. A method as claimed in claim 3, wherein step (c) is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant selected gap, said negative electrodes being spaced from one another by a distance at least equal to said electrode gap;

ii) filling said electrode gap with said electrocoagulation printing ink;

iii) electrically energizing selected ones of said negative electrodes to cause point-by-point selective coagulation and adherence of the colloid onto the olefin and silica-coated positive electrode active surface opposite the electrode active surfaces of said energized negative electrodes while said positive electrode is rotating, to form said dots of colored, coagulated colloid; and iv) removing any remaining non-coagulated colloid from said positive electrode active surface.

12. A method as claimed in claim 3, wherein said positive electrode active surface and said ink are maintained at a temperature of about 35° C. to about 60° C. to increase viscosity of the coagulated colloid in step (c) so that the dots of colored, coagulated colloid remain coherent during transfer in step (d).

13. A method as claimed in claim 12, wherein the temperature of said positive electrode active surface and said ink is about 40° C.

14. A method as claimed in claim 12, wherein said ink is maintained at said temperature by heating said positive electrode active surface and applying said ink on the heated electrode surface to cause a transfer of heat therefrom to said ink.

15. A method as claimed in claim 12, further including the step of removing after step (d) of each printing stage any remaining coagulated colloid from said positive electrode active surface.

16. A method as claimed in claim 15, wherein said positive electrode is rotatable in a selected direction and wherein any remaining coagulated colloid is removed from said positive electrode active surface by providing an elongated rotatable brush extending parallel to the longitudinal axis of said positive electrode, said brush being provided with a plurality of radially extending bristles having extremities contacting said positive electrode active surface, rotating said brush in a direction opposite to the direction of rotation of said positive electrode to cause said bristles to frictionally engage said positive electrode active surface, and directing jets of cleaning liquid under pressure against said positive electrode active surface, from either side of said brush.

17. A method as claimed in claim 16, wherein said positive electrode active surface and said ink are maintained at said temperature by heating said cleaning liquid to heat said positive electrode active surface upon contacting same and applying said ink on the heated electrode surface to cause a transfer of heat therefrom to said ink.

18. A method as claimed in claim 3, wherein step (d) is carried out by providing at each transfer position a pressure roller extending parallel to said positive electrode and pressed thereagainst to form a nip and permit said pressure roller to be driven by said positive electrode upon rotation thereof, and passing said substrate through said nip.

19. A method as claimed in claim 18, wherein there are at least two printing stages each including one said pressure roller and wherein said pressure rollers are arranged in pairs with the pressure rollers of each pair being diametrically opposed to one another.

20. A method as claimed in claim 1, wherein said olefinic substance is selected from the group consisting of unsaturated fatty acids and unsaturated vegetable oils.

21. A method as claimed in claim 20, wherein said olefinic substance is an unsaturated fatty acid selected from the group consisting of arachidonic acid, linoleic acid, linolenic acid, oleic acid and palmitoleic acid.

22. A method as claimed in claim 21, wherein said liquid olefinic substance is oleic acid.

23. A method as claimed in claim 20, wherein said olefinic substance is an unsaturated vegetable oil selected from the group consisting of corn oil, linseed oil, olive oil, peanut oil, soybean oil and sunflower oil.

24. A method as claimed in claim 24, wherein said silica has a surface area of about 100 to about 500 $m^2/g$, as measured by the Brunaver-Emmet-Teller nitrogen absorption method.

25. A method as claimed in claim 24, wherein the surface area of said silica is about 400 $m^2/g$.

26. A method as claimed in claim 1, wherein said positive electrode is a cylindrical electrode having a central longitudinal axis and rotating at a constant speed about said longitudinal axis, and wherein steps (a), (b), (c) and (d) are repeated several times to define a corresponding number of printing stages each using a coloring agent of different color and to produce several differently colored images of coagulated colloid which are transferred at respective transfer positions onto said substrate in superimposed relation to provide a polychromic image.

27. A method as claimed in claim 26, wherein said printing stages are arranged in tandem relation and wherein said substrate is in the form of a continuous web which is passed through said respective transfer positions for being imprinted with said colored images at said printing stages.

28. A method as claimed in claim 26, wherein said printing stages are arranged around a single roller adapted to bring said substrate into contact with the dots of colored, coagulated colloid of each printing stage, and wherein said substrate is in the form of a continuous web which is partially wrapped around said roller and passed through said respective transfer positions for being imprinted with said colored images at said printing stages.

29. A method as claimed in claim 26, wherein step (b) is carried out by providing a distribution roller extending parallel to said positive electrode and having a peripheral coating comprising an oxide ceramic material, applying said olefinic substance in the form of an oily dispersion containing said silica as dispersed phase onto the ceramic coating to form on a surface thereof a film of said oily dispersion uniformly covering the surface of said ceramic coating, said film of oily dispersion breaking down into micro-droplets containing said olefinic substance in admixture with said silica and having substantially uniform size and distribution, and transferring said micro-droplets from said ceramic coating onto said positive electrode active surface.

30. A method as claimed in claim 29, wherein said oxide ceramic material comprises a fused mixture of alumina and titania.

31. A method as claimed in claim 29, wherein said oily dispersion is applied onto said ceramic coating by disposing an applicator roller parallel to said distribution roller and in pressure contact engagement therewith to form a first nip, and rotating said applicator roller and said distribution roller in register while feeding said oily dispersion into said first nip, such that said oily dispersion upon passing through said first nip forms said film uniformly covering the surface of said ceramic coating.

32. A method as claimed in claim 31, wherein said micro-droplets are transferred from said distribution roller to said positive electrode by disposing a transfer roller parallel to said distribution roller and in contact engagement therewith to form a second nip, positioning said transfer roller in pressure contact engagement with said positive electrode to form a third nip, and rotating said transfer roller and said positive electrode in register for transferring said micro-droplets from said distribution roller to said transfer roller at said second nip and thereafter transferring said micro-droplets from said transfer roller to said positive electrode at said third nip.

33. A method as claimed in claim 32, wherein said applicator roller and said transfer roller are each provided with a peripheral covering of a resilient material which is resistant to attack by said further olefinic substance.

34. A method as claimed in claim 29, wherein said silica is present in said oily dispersion in an amount of about 5 to about 30% by weight, based on the total weight of said dispersion.

35. A method as claimed in claim 34, wherein the amount of silica is about 7.5% by weight.

36. A method as claimed in claim 29, wherein said silica has a BET surface area of about 100 to about 500 $m^2/g$, as measured by the Brunaver-Emmet-Teller nitrogen absorption method.

37. A method as claimed in claim 36, wherein the surface area of said silica is about 400 $m^2/g$.

38. A method as claimed in claim 26, wherein step (c) is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant selected gap, said negative electrodes being spaced from one another by a distance at least equal to said electrode gap;

ii) filling said electrode gap with said electrocoagulation printing ink;

iii) electrically energizing selected ones of said negative electrodes to cause point-by-point selective coagulation and adherence of the colloid onto the olefin and silica-coated positive electrode active surface opposite the electrode active surfaces of said energized negative electrodes while said positive electrode is rotating, to form said dots of colored, coagulated colloid; and iv) removing any remaining non-coagulated colloid from said positive electrode active surface.

39. A method as claimed in claim 26, wherein said positive electrode active surface and said ink are maintained at a temperature of about 35° C. to about 60° C. to increase viscosity of the coagulated colloid in step (c) so that the dots of colored, coagulated colloid remain coherent during transfer in step (d).

40. A method as claimed in claim 39, wherein the temperature of said positive electrode active surface and said ink is about 40° C.

41. A method as claimed in claim 39, wherein said ink is maintained at said temperature by heating said positive electrode active surface and applying said ink on the heated electrode surface to cause a transfer of heat therefrom to said ink.

42. A method as claimed in claim 39, further including the step of removing after step (d) of each printing stage any remaining coagulated colloid from said positive electrode active surface.

43. A method as claimed in claim 42, wherein said positive electrode is rotatable in a selected direction and wherein any remaining coagulated colloid is removed from said positive electrode active surface by providing an elongated rotatable brush extending parallel to the longitudinal axis of said positive electrode, said brush being provided with a plurality of radially extending bristles having extremities contacting said positive electrode active surface, rotating said brush in a direction opposite to the direction of rotation of said positive electrode to cause said bristles to frictionally engage said positive electrode active surface, and directing jets of cleaning liquid under pressure against said positive electrode active surface, from either side of said brush.

44. A method as claimed in claim 43, wherein said positive electrode active surface and said ink are maintained at said temperature by heating said cleaning liquid to heat said positive electrode active surface upon contacting same and applying said ink on the heated electrode surface to cause a transfer of heat therefrom to said ink.

45. A multicolor electrocoagulation printing method comprising the steps of:

a) providing a positive electrolytically inert electrode having a continuous passivated surface moving at a constant speed along a selected path, said passivated surface defining a positive electrode active surface;

b) coating the positive electrode active surface with an olefinic substance and silica to form on said surface micro-droplets of olefinic substance containing the silica;

c) forming on the olefin and silica-coated positive electrode active surface a plurality of dots of colored, coagulated colloid representative of a desired image, by electrocoagulation of an electrolytically coagulable colloid present in an electrocoagulation printing ink comprising a liquid colloidal dispersion containing said electrolytically coagulable colloid, a dispersing medium, a soluble electrolyte and a coloring agent;

d) bringing an endless non-extendible belt moving at substantially the same speed as said positive electrode and having on one side thereof a colloid retaining surface adapted to releasably retain dots of electrocoagulated colloid, into contact with the olefin and silica-coated positive electrode active surface to cause transfer of the dots of colored,. coagulated colloid from the positive electrode active surface onto the colloid retaining surface of said belt and to imprint said colloid retaining surface with the image;

e) repeating steps (b), (c) and (d) several times to define a corresponding number of printing stages arranged at selected locations along said path and each using a coloring agent of different color, and to produce several differently colored images of coagulated colloid which are transferred at respective transfer positions onto said colloid retaining surface in superimposed relation to provide a polychromic image; and f) bringing a substrate into contact with the colloid retaining surface of said belt to cause transfer of the polychromic image from said colloid retaining surface onto said substrate and to imprint said substrate with said polychromic image.

46. A method as claimed in claim 45, wherein said positive electrode is a cylindrical electrode having a central longitudinal axis and rotating at substantially constant speed about said longitudinal axis, and wherein said printing stages are arranged around said positive cylindrical electrode.

47. A method as claimed in claim 46, wherein step (b) is carried out by providing a distribution roller extending parallel to said positive electrode and having a peripheral coating comprising an oxide ceramic material, applying said olefinic substance in the form of an oily dispersion containing said silica as dispersed phase onto the ceramic coating to form on a surface thereof a film of said oily dispersion uniformly covering the surface of said ceramic coating, said film of oily dispersion breaking down into micro-droplets containing said olefinic substance in admixture with said silica and having substantially uniform size and distribution, and transferring said micro-droplets from said ceramic coating onto said positive electrode active surface.

48. A method as claimed in claim 47, wherein said oxide ceramic material comprises a fused mixture of alumina and titania.

49. A method as claimed in claim 47, wherein said oily dispersion is applied onto said ceramic coating by disposing an applicator roller parallel to said distribution roller and in pressure contact engagement therewith to form a first nip, and rotating said applicator roller and said distribution roller in register while feeding said oily dispersion into said first nip, such that said oily dispersion upon passing through said first nip forms said film uniformly covering the surface of said ceramic coating.

50. A method as claimed in claim 49, wherein said micro-droplets are transferred from said distribution roller to said positive electrode by disposing a transfer roller parallel to said distribution roller and in contact engagement therewith to form a second nip, positioning said transfer roller in pressure contact engagement with said positive electrode to form a third nip, and rotating said transfer roller and said positive electrode in register for transferring said micro-droplets from said distribution roller to said transfer roller at said second nip and thereafter transferring said micro-droplets from said transfer roller to said positive electrode at said third nip.

51. A method as claimed in claim 50, wherein said applicator roller and said transfer roller are each provided with a peripheral covering of a resilient material which is resistant to attack by said olefinic substance.

52. A method as claimed in claim 47, wherein said silica is present in said oily dispersion in an amount of about 5 to about 30% by weight, based on the total weight of said dispersion.

53. A method as claimed in claim 52, wherein the amount of silica is about 7.5% by weight.

54. A method as claimed in claim 46, wherein step (c) is carried out by:

i) providing a plurality of negative electrolytically inert electrodes electrically insulated from one another and arranged in rectilinear alignment to define a series of corresponding negative electrode active surfaces disposed in a plane parallel to the longitudinal axis of said positive electrode and spaced from the positive electrode active surface by a constant selected gap, said negative electrodes being spaced from one another by a distance at least equal to said electrode gap;

ii) filling said electrode gap with said electrocoagulation printing ink;

iii) electrically energizing selected ones of said negative electrodes to cause point-by-point selective coagulation and adherence of the colloid onto the olefin and silica-coated positive electrode active surface opposite the electrode active surfaces of said energized negative electrodes while said positive electrode is rotating, to form said dots of colored, coagulated colloid; and iv) removing any remaining non-coagulated colloid from said positive electrode active surface.

55. A method as claimed in claim 46, wherein step (c) is carried out by providing at each transfer position a pressure roller extending parallel to said positive electrode and pressed thereagainst to form a nip and permit said pressure roller to be driven by said positive electrode upon rotation thereof, and passing said belt through said nip.

56. A method as claimed in claim 55, wherein there are at least two printing stages each including one said pressure roller and wherein said pressure rollers are arranged in pairs with the pressure rollers of each pair being diametrically opposed to one another.

57. A method as claimed in claim 46, further including the step of removing after step (d) of each printing stage any remaining coagulated colloid from said positive electrode active surface.

58. A method as claimed in claim 57, wherein said positive electrode is rotatable in a predetermined direction and wherein any remaining coagulated colloid is removed from said positive electrode active surface by providing an elongated rotatable brush extending parallel to the longitudinal axis of said positive electrode, said brush being provided with a plurality of radially extending bristles having extremities contacting said positive electrode active surface, rotating said brush in a direction opposite to the direction of rotation of said positive electrode so as to cause said bristles to frictionally engage said positive electrode active surface, and directing jets of cleaning liquid under pressure against said positive electrode active surface, from either side of said brush.

59. A method as claimed in claim 46, wherein said substrate is in the form of a continuous web and wherein step (f) is carried out by providing a support roller and a pressure roller extending parallel to said support roller and pressed thereagainst to form a nip through which said belt is passed, said support roller and pressure roller being driven by said belt upon movement thereof, and guiding said web so as to pass through said nip between said pressure roller and the colloid retaining surface of said belt for imprinting said web with said polychromic image.

60. A method as claimed in claim 59, further including the step of guiding said belt with the colloid retaining surface thereof imprinted with said polychromic image so that said belt travels along a path extending in a plane intersecting the longitudinal axis of said positive electrode at right angles, thereby exposing said colloid retaining surface to permit contacting thereof by said web.

61. A method as claimed in claim 60, wherein the longitudinal axis of said positive electrode extends vertically and wherein said belt is guided so as to travel along a horizontal path with said colloid retaining surface facing downwardly, said support roller and pressure roller having rotation axes disposed in a plane extending perpendicular to said horizontal path.

62. A method as claimed in claim 45, wherein said olefinic substance is selected from the group consisting of unsaturated fatty acids and unsaturated vegetable oils.

63. A method as claimed in claim 62, wherein said olefinic substance is an unsaturated fatty acid selected from the group consisting of arachidonic acid, linoleic acid, linolenic acid, oleic acid and palmitoleic acid.

64. A method as claimed in claim 63, wherein said olefinic substance is oleic acid.

65. A method as claimed in claim 64 wherein said olefinic substance is an unsaturated vegetable oil selected from the group consisting of corn oil, linseed oil, olive oil, peanut oil, soybean oil and sunflower oil.

66. A method as claimed in claim 45, wherein said silica has a surface area of about 100 to about 500 $m^2/g$, as measured by the Brunaver-Emmet-Teller nitrogen adsorption method.

67. A method as claimed in claim 66, wherein the surface area of said silica is about 400 $m^2/g$.

68. A method as claimed in claim 45, wherein said dispersing medium is water and wherein the dots of differently colored, coagulated colloid representative of said polychromic image are moistened between steps (e) and (f) so that said polychromic image is substantially completely transferred onto said substrate in step (f).

69. A method as claimed in claim 45, wherein any remaining coagulated colloid is removed from the colloid retaining surface of said belt by providing at least one elongated rotatable brush disposed on said one side of said belt and at least one support roller extending parallel to said brush and disposed on the opposite side of said belt, said brush and support roller having rotation axes disposed in a plane extending perpendicular to said belt, said brush being provided with a plurality of radially extending bristles having extremities contacting said colloid retaining surface, rotating said brush in a direction opposite to the direction of movement of said belt so as to cause said bristles to frictionally engage said colloid retaining surface while supporting said belt with said support roller, directing jets of cleaning liquid under pressure against said colloid retaining surface from either side of said brush and removing said cleaning liquid with any dislodged coagulated colloid from said colloid retaining surface.

* * * * *